US009376843B2

(12) United States Patent
Akizuki et al.

(10) Patent No.: US 9,376,843 B2
(45) Date of Patent: Jun. 28, 2016

(54) POSITION HOLDING DEVICE FOR ROTATING LEVER AND VEHICLE DOOR LOCK DEVICE PROVIDED WITH SAID POSITION HOLDING DEVICE FOR ROTATING LEVER

(75) Inventors: Ryujiro Akizuki, Novi, MI (US); Takashi Nishio, Kariya (JP); Nobuko Watanabe, Takahama (JP); Masayuki Tomochika, Anjo (JP); Masanari Iwata, Ichinomiya (JP); Yasuhiko Sono, Hekinan (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 175 days.

(21) Appl. No.: 14/111,427

(22) PCT Filed: Apr. 12, 2012

(86) PCT No.: PCT/JP2012/060022
§ 371 (c)(1),
(2), (4) Date: Oct. 11, 2013

(87) PCT Pub. No.: WO2012/144413
PCT Pub. Date: Oct. 26, 2012

(65) Prior Publication Data

US 2014/0028036 A1 Jan. 30, 2014

(30) Foreign Application Priority Data

Apr. 22, 2011 (JP) ..... 2011-095737

(51) Int. Cl.
*E05C 3/06* (2006.01)
*E05B 83/36* (2014.01)
(Continued)

(52) U.S. Cl.
CPC ..... *E05B 83/36* (2013.01); *E05B 15/0053* (2013.01); *E05B 15/04* (2013.01);
(Continued)

(58) Field of Classification Search
CPC ..... E05B 15/0053; E05B 15/04; E05B 77/36; Y10T 292/57
USPC ..... 292/201, 216, DIG. 23, DIG. 61
See application file for complete search history.

(56) References Cited

U.S. PATENT DOCUMENTS 4,907,831 A * 3/1990 Di Giusto ..... E05B 85/26 292/210
4,934,746 A * 6/1990 Yamada ..... E05B 81/06 292/201

(Continued)

FOREIGN PATENT DOCUMENTS

| | | | |
|---|---|---|---|
| JP | 1-96016 | U | 6/1989 |
| JP | 1-142023 | U | 9/1989 |
| JP | 2002-132363 | A | 5/2002 |
| JP | 2009-46908 | A | 3/2009 |
| JP | 427741 | B2 | 3/2009 |

OTHER PUBLICATIONS

The extended European Search Report issued on Dec. 9, 2014 by the European Patent Office in corresponding European Patent Application No. 12773643.7-1603 (7 pages).

(Continued)

*Primary Examiner* — Kristina Fulton
*Assistant Examiner* — Faria Ahmad
(74) *Attorney, Agent, or Firm* — Buchanan Ingersoll & Rooney PC

(57) ABSTRACT

Provided is a position holding device for a rotating lever, which includes a rotating lever and a torsion spring, and is capable of elastically holding the rotating lever at the two positions including a first position and a second position. The torsion spring includes a coiled part, and a first arm part and a second arm part each extending from the coiled part and facing each other across an engagement portion of the rotating lever. The first arm part includes a mountain portion formed at an intermediate portion thereof. The second arm part includes an urging portion. As a result, an urging force generated by the urging portion can be applied to the rotating lever as a braking force against an urging force generated by the mountain portion. Consequently, it is possible to reduce an abutment noise generated when the rotating lever abuts against a stopper member.

5 Claims, 6 Drawing Sheets

(51) Int. Cl.

| | |
|---|---|
| ***E05B 15/00*** | (2006.01) |
| ***G05G 1/04*** | (2006.01) |
| ***G05G 5/06*** | (2006.01) |
| ***E05B 15/04*** | (2006.01) |
| ***E05B 77/36*** | (2014.01) |
| *E05C 3/16* | (2006.01) |
| *E05B 79/08* | (2014.01) |
| *E05B 81/16* | (2014.01) |

(52) U.S. Cl.
CPC ..... *E05B 77/36* (2013.01); *G05G 1/04* (2013.01); *G05G 5/06* (2013.01); *E05B 79/08* (2013.01); *E05B 81/16* (2013.01); *E05B 2015/0496* (2013.01); *Y10T 74/20582* (2015.01); *Y10T 292/57* (2015.04)

(56) References Cited

U.S. PATENT DOCUMENTS 4,936,611 A * 6/1990 Palvolgyi ..... E05B 83/16 292/216
4,961,601 A * 10/1990 Lindholm ..... E05B 83/16 292/216
4,969,673 A * 11/1990 Portelli ..... E05B 77/265 292/216
4,978,153 A * 12/1990 Hirsch ..... B04B 7/06 292/201
4,988,135 A * 1/1991 Ottino ..... E05B 81/20 292/201
5,046,769 A * 9/1991 Rimbey ..... E05B 77/265 292/216
5,156,424 A * 10/1992 Nakamura ..... E05B 63/14 292/216
5,273,325 A * 12/1993 Zimmermann ..... E05B 81/22 292/216
5,409,273 A * 4/1995 Claar ..... E05B 81/22 292/201
5,938,253 A * 8/1999 Szablewski ..... E05B 81/14 292/201
6,056,334 A * 5/2000 Petzold ..... E05B 81/14 292/201
6,135,514 A * 10/2000 Kowalewski ..... E05B 83/16 292/216
6,279,361 B1 * 8/2001 Baukholt ..... E05B 81/14 292/201
6,343,817 B1 * 2/2002 Watanabe ..... E05B 77/30 292/201
6,364,379 B1 * 4/2002 Roberts ..... E05B 83/16 292/216
6,382,687 B1 * 5/2002 Gruhn ..... E05B 81/14 292/201
6,406,073 B1 * 6/2002 Watanabe ..... E05B 77/265 292/216
6,428,058 B1 * 8/2002 Graute ..... E05B 85/01 292/201
6,435,573 B1 * 8/2002 Szablewski ..... E05B 81/14 292/201
6,471,260 B1 * 10/2002 Weinerman ..... E05C 3/24 292/143
6,575,507 B2 * 6/2003 Reddmann ..... E05B 81/14 292/201
6,581,987 B1 * 6/2003 Gentile ..... E05B 83/24 292/216
6,629,710 B1 * 10/2003 Shafry ..... B60N 2/01583 292/216
6,705,140 B1 * 3/2004 Dimig ..... E05B 81/06 292/201
6,764,113 B1 * 7/2004 Cetnar ..... 292/201
6,779,820 B2 * 8/2004 Ogino ..... E05B 83/16 292/216
6,824,177 B1 * 11/2004 Nass ..... E05B 81/16 292/201
6,945,585 B1 * 9/2005 Liu et al. ..... 296/65.03
7,055,872 B2 * 6/2006 Hayakawa ..... E05B 81/06 292/201
7,261,337 B2 * 8/2007 Nakagome et al. ..... 292/216
7,309,100 B2 * 12/2007 Sawajiri ..... E05B 83/38 292/336.3
7,467,815 B2 * 12/2008 Larsen et al. ..... 292/201
7,568,741 B2 * 8/2009 Odahara ..... E05B 81/06 292/201
7,621,571 B2 * 11/2009 Umino ..... E05B 81/06 292/201
7,926,857 B2 * 4/2011 Akizuki ..... E05B 77/26 292/201
7,926,858 B2 * 4/2011 Otsuka ..... B60N 2/01583 292/216
7,954,898 B2 * 6/2011 Van De Geer ..... B60N 2/01583 292/200
8,006,583 B2 * 8/2011 Yoda ..... E05B 83/36 292/201
8,128,135 B2 * 3/2012 Maeta ..... B60N 2/01583 292/201
8,256,805 B2 * 9/2012 Ishiguro ..... E05B 77/26 292/201
8,276,949 B2 * 10/2012 Akizuki ..... E05B 77/06 292/201
8,740,264 B2 * 6/2014 Akizuki ..... E05B 77/265 292/201
8,814,226 B2 * 8/2014 Akizuki ..... E05B 77/30 292/196
8,827,328 B2 * 9/2014 Akizuki ..... E05B 81/06 292/196
8,827,329 B2 * 9/2014 Scholz ..... E05B 85/26 292/200
8,833,808 B2 * 9/2014 Watanabe ..... E05B 81/14 292/201
8,919,827 B2 * 12/2014 Akizuki ..... E05B 81/06 292/201
8,955,889 B2 * 2/2015 Bendel ..... E05B 81/20 292/200
8,967,678 B2 * 3/2015 Rosales ..... E05B 15/04 292/196
8,979,145 B2 * 3/2015 Yamagata ..... E05B 83/36 292/201
9,016,734 B2 * 4/2015 Barth ..... E05B 85/243 292/201
9,109,382 B2 * 8/2015 Yamaguchi ..... E05B 81/06
2001/0024040 A1 * 9/2001 Spurr ..... E05B 85/243 292/216
2002/0117863 A1 * 8/2002 Shinkawa ..... E05B 81/06 292/216
2002/0167178 A1 * 11/2002 Spurr ..... E05B 77/02 292/201
2003/0160461 A1 * 8/2003 Promutico ..... D06F 37/42 292/216
2003/0234544 A1 * 12/2003 Jankowski ..... E05B 77/06 292/220
2004/0113437 A1 6/2004 Hayakawa et al.
2004/0119296 A1 * 6/2004 Hayakawa ..... E05B 81/06 292/216
2006/0163883 A1 * 7/2006 Hoshikawa ..... E05B 83/36 292/216
2006/0267351 A1 * 11/2006 Spurr ..... E05B 81/20 292/216
2006/0284426 A1 * 12/2006 Bigazzi ..... E05B 81/14 292/216
2008/0078215 A1 4/2008 Odahara
2008/0224482 A1 * 9/2008 Cumbo ..... E05B 77/02 292/216
2009/0241617 A1 * 10/2009 Takahashi ..... E05B 81/16 70/257
2010/0013246 A1 * 1/2010 Tomaszewski ..... E05B 85/01 292/216
2010/0171321 A1 * 7/2010 Akizuki ..... E05B 77/26 292/200
2011/0012376 A1 * 1/2011 Hunt ..... E05B 85/26 292/216
2011/0162419 A1 * 7/2011 Akizuki ..... E05B 77/28 70/141
2011/0254287 A1 * 10/2011 Akizuki ..... E05B 77/06 292/223

(56) References Cited

U.S. PATENT DOCUMENTS

| | | | | |
|---|---|---|---|---|
| 2011/0260476 | A1* | 10/2011 | Akizuki | E05B 81/06 292/200 |
| 2012/0000258 | A1* | 1/2012 | Akizuki | E05B 81/06 70/91 |
| 2012/0118029 | A1* | 5/2012 | Akizuki | E05B 17/041 70/91 |
| 2012/0119520 | A1* | 5/2012 | Akizuki | E05B 77/30 292/196 |
| 2014/0047874 | A1* | 2/2014 | Akizuki | E05B 77/26 70/91 |

OTHER PUBLICATIONS

International Search Report (PCT/ISA/210) mailed on May 22, 2012, by the Japanese Patent Office as the International Searching Authority for International Application No. PCT/JP2012/060022.

Written Opinion (PCT/ISA/237) mailed on May 22, 2012, by the Japanese Patent Office as the International Searching Authority for International Application No. PCT/JP2012/060022.

* cited by examiner

POSITION HOLDING DEVICE FOR ROTATING LEVER AND VEHICLE DOOR LOCK DEVICE PROVIDED WITH SAID POSITION HOLDING DEVICE FOR ROTATING LEVER

TECHNICAL FIELD

The present invention relates to a position holding device for a rotating lever, which is capable of holding the rotating lever elastically between two positions (first position and second position), and to a vehicle door lock device provided with the position holding device for a rotating lever.

BACKGROUND ART

Conventionally, as the position holding device of this type, there has been known one disclosed in Patent Literature 1. This position holding device for a rotating lever includes a rotating lever rotatably supported by a base member in such a manner that the rotating lever abuts against a first stopper member to be held at a first position, and abuts against a second stopper member to be held at a second position, and a torsion spring that is interposed between the rotating lever and the base member, urges the rotating lever toward the first stopper member at the first position, and urges the rotating lever toward the second stopper member at the second position. The rotating lever can be held elastically at the two positions including the first position and the second position.

The torsion spring employed in this conventional device includes a coiled part mounted to be rotatable about a boss portion provided upright to the base member, and a first arm part and a second arm part that extend from the coiled part in a radial direction substantially orthogonal to an axial direction of the boss portion and face each other across an engagement portion provided to the rotating lever.

CITATION LIST

Patent Literature

[PTL 1] JP 4277441 B

SUMMARY OF INVENTION

Technical Problems

In the conventional device described above, the first arm part and the second arm part of the torsion spring are each provided with a mountain portion (projection-like bent portion) including a top portion that is brought into engagement with the engagement portion in a manner that the engagement portion climbs over the top portion at an intermediate part of a circular-arc locus formed along with rotation of the rotating lever between the first position and the second position, the mountain portion urging the rotating lever toward the first stopper member when the rotating lever is held at the first position, and urging the rotating lever toward the second stopper member when the rotating lever is held at the second position.

Thus, when the first arm part and the second arm part of the torsion spring function similarly and respectively at the first position and the second position so as to abut the rotating lever respectively against the stopper members, an urging force exerted by the first arm part and an urging force exerted by the second arm part are applied in the same direction. Thus, in order to reduce abutment noises generated when the rotating lever abuts against the stopper members, buffers need to be provided respectively between abutment parts of the rotating lever with respect to the stopper members and the stopper members. Alternatively, a raw material for each of the abutment parts of the rotating lever with respect to the stopper members or a raw material for each of the stopper members needs to be changed to a raw material having a buffer function. In this way, there are problems of an increase of the number of components and an increase in material cost.

Solution to Problems

The present invention has been made to solve the problems described above.

According to one embodiment of the present invention, there is provided a position holding device for a rotating lever, including:

a rotating lever that is rotatably supported by a base member in a manner that the rotating lever abuts against a first stopper member to be held at a first position, and abuts against a second stopper member to be held at a second position; and a torsion spring that is interposed between the rotating lever and the base member, urges the rotating lever toward the first stopper member at the first position, and urges the rotating lever toward the second stopper member at the second position, the position holding device being capable of holding the rotating lever elastically at two positions including the first position and the second position, in which the torsion spring includes:

a coiled part supported by the base member; and a first arm part and a second arm part each extending from the coiled part in a radial direction thereof, the first arm part and the second arm part facing each other across an engagement portion provided to the rotating lever, in which the first arm part includes a mountain portion (projection-like bent portion) including a top portion that is brought into engagement with the engagement portion in a manner that the engagement portion climbs over the top portion at an intermediate part of a circular-arc locus formed along with rotation of the rotating lever from the first position to the second position, the mountain portion urging the rotating lever toward the first stopper member when the rotating lever is held at the first position, and urging the rotating lever toward the second stopper member when the rotating lever is held at the second position, and in which the second arm part includes an urging portion that is brought into engagement with the engagement portion when the rotating lever rotates at least from the intermediate part to the first position, the urging portion urging the rotating lever toward the second stopper member with an urging force smaller than an urging force exerted by the first arm part toward the first stopper member when the rotating lever is held at the first position (invention according to claim 1).

In this case, the urging portion may include a straight portion that is brought into the engagement with the engagement portion in a manner that the engagement portion constantly slides downward along the circular-arc locus formed along with the rotation of the rotating lever from the first position to the second position, the straight portion urging the rotating lever toward the second stopper member with the urging force smaller than the urging force exerted by the first arm part toward the first stopper member when the rotating lever is held at the first position, and urging the rotating lever toward the second stopper member when the rotating lever is held at the second position (invention according to claim 2).

In this case, the present invention can be carried out with a simple structure in which the urging portion is changed to the straight portion.

Advantageous Effects of Invention

According to the present invention described above, when the rotating lever rotates from the first position to the second position and rotates from the second position to the first position, the engagement portion of the rotating lever climbs, at the intermediate part of the circular-arc locus, over the top portion of the mountain portion provided to the first arm part of the torsion spring. Thus, the rotating lever is allowed to provide tactile feedback. Further, when the rotating lever rotates from the second position to the first position, after the engagement portion of the rotating lever climbs over the top portion of the mountain portion provided to the first arm part of the torsion spring and before the rotating lever abuts against the first stopper member, the engagement portion of the rotating lever is urged toward the second stopper member by the urging portion (straight portion) provided to the second arm part of the torsion spring with the urging force smaller than the urging force exerted by the first arm part of the torsion spring toward the first stopper member.

Thus, the urging force generated toward the second stopper member by the urging portion (straight portion) provided to the second arm part of the torsion spring is applied to the rotating lever as a braking force against the urging force generated toward the first stopper member by the mountain portion provided to the first arm part of the torsion spring. Thus, an abutment noise generated when the rotating lever abuts against the first stopper member can be reduced. Thus, it is unnecessary to take a measure to reduce the abutment noise (such as provision of a buffer between an abutment part of the rotating lever with respect to the first stopper member and the first stopper member, and a change of a raw material for the abutment part of the rotating lever with respect to the first stopper member or a raw material for the first stopper member to a raw material having a buffer function). As a result, the number of components for the measure to reduce the abutment noise is not increased, or material cost is not increased.

Further, in one embodiment of the present invention, the urging portion may include: a first urging portion that is brought into engagement with the engagement portion when the rotating lever rotates from the intermediate part to the first position, the first urging portion urging the rotating lever toward the second stopper member with an urging force smaller than the urging force exerted by the first arm part toward the first stopper member when the rotating lever is held at the first position; and a second urging portion that is brought into engagement with the engagement portion when the rotating lever rotates from the intermediate part to the second position, the second urging portion urging the rotating lever toward the first stopper member with an urging force smaller than an urging force exerted by the first arm part toward the second stopper member when the rotating lever is held at the second position (invention according to claim 3).

According to this embodiment of the present invention, the urging portion includes the first urging portion and the second urging portion. Thus, a braking force is generated by the first urging portion before the rotating lever abuts against the first stopper member, and another braking force is generated by the second urging portion before the rotating lever abuts against the second stopper member. In this way, the abutment noise generated when the rotating lever abuts against the first stopper member can be reduced, and an abutment noise generated when the rotating lever abuts against the second stopper member also can be reduced.

Further, in one embodiment of the present invention, the position holding device for a rotating lever may further include a spring for constantly urging the rotating lever toward the first position with an urging force smaller than an urging force of the torsion spring (invention according to claim 4).

According to this embodiment of the present invention, a braking force is generated by the urging portion of the second arm part of the torsion spring before the rotating lever abuts against the first stopper member, and another braking force is generated by the urging force of the spring before the rotating lever abuts against the second stopper member. In this way, the abutment noise generated when the rotating lever abuts against the first stopper member can be reduced, and the abutment noise generated when the rotating lever abuts against the second stopper member also can be reduced.

In this case, there may be provided a vehicle door lock device, including: the above-mentioned position holding device for a rotating lever; a latch mechanism that is capable of holding a door in a closed state with respect to a vehicle body, and includes a lift lever; and an open link that shifts from a locked position at which the open link is engageable with the lift lever to an unlocked position at which the open link is unengageable with the lift lever so as to switch the door from a locked state to an unlocked state, in which the rotating lever is an active lever that rotates between the first position and the second position, the first position corresponding to the unlocked position of the open link and the second position corresponding to the locked position of the open link, and in which the spring is a return spring for urging the open link toward the unlocked position (invention according to claim 5). In this case, abnormal noises (abutment noises) generated at the time of a locking operation (when the active lever rotates from the unlocking position (first position) to the locking position (second position)) and at the time of an unlocking operation (when the active lever rotates from the locking position (second position) to the unlocking position (first position)) of the vehicle door lock device can be reduced.

Alternatively, the present invention can be carried out by employing the following torsion spring (including a second arm part different from the second arm part described above only in shape and function) instead of the torsion spring described above. The second arm part of the torsion spring is provided with a straight portion that is brought into engagement with the engagement portion in a manner that the engagement portion constantly slides upward along a circular-arc locus formed along with rotation of the rotating lever from the first position to the second position, the straight portion urging the rotating lever toward the first stopper member when the rotating lever is held at the first position, and urging the rotating lever toward the first stopper member with an urging force smaller than an urging force exerted by the first arm part toward the second stopper member when the rotating lever is held at the second position (invention according to claim 6).

According to this embodiment of the present invention, when the rotating lever rotates from the first position to the second position and rotates from the second position to the first position, the engagement portion of the rotating lever climbs, at the intermediate part of the circular-arc locus, over the top portion of the mountain portion provided to the first arm part of the torsion spring. Thus, the rotating lever is allowed to provide tactile feedback. Further, when the rotating lever rotates from the first position to the second position, after the engagement portion of the rotating lever climbs over the top portion of the mountain portion provided to the first arm part of the torsion spring and before the rotating lever abuts against the second stopper member, the engagement portion of the rotating lever is urged toward the first stopper member by the straight portion provided to the second arm part of the torsion spring with the urging force smaller than the urging force exerted by the first arm part of the torsion spring toward the second stopper member.

Thus, the urging force generated toward the first stopper member by the straight portion provided to the second arm part of the torsion spring is applied to the rotating lever as a braking force against the urging force generated toward the second stopper member by the mountain portion provided to the first arm part of the torsion spring. Thus, an abutment noise generated when the rotating lever abuts against the second stopper member can be reduced. Thus, it is unnecessary to take a measure to reduce the abutment noise (such as provision of a buffer between an abutment part of the rotating lever with respect to the second stopper member and the second stopper member, and a change of a raw material for the abutment part of the rotating lever with respect to the second stopper member or a raw material for the second stopper member to a raw material having a buffer function). As a result, the number of components for the measure to reduce the abutment noise is not increased, or material cost is not increased.

DESCRIPTION OF EMBODIMENTS

Figure 1:
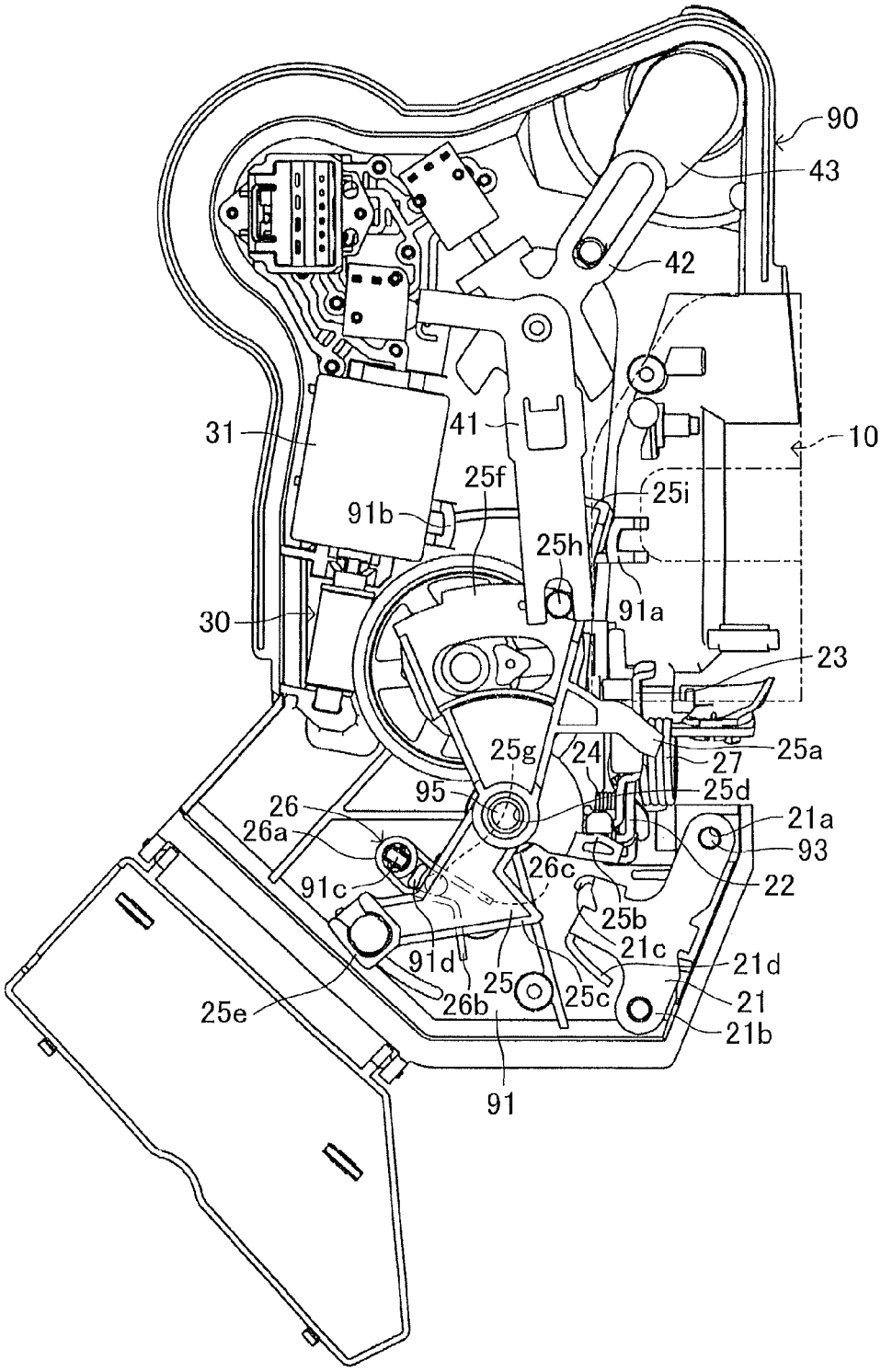
FIG. 1 is a side view illustrating an example of an embodiment of the present invention in which a position holding device for a rotating lever is applied to a vehicle door lock device.
Figure 2:
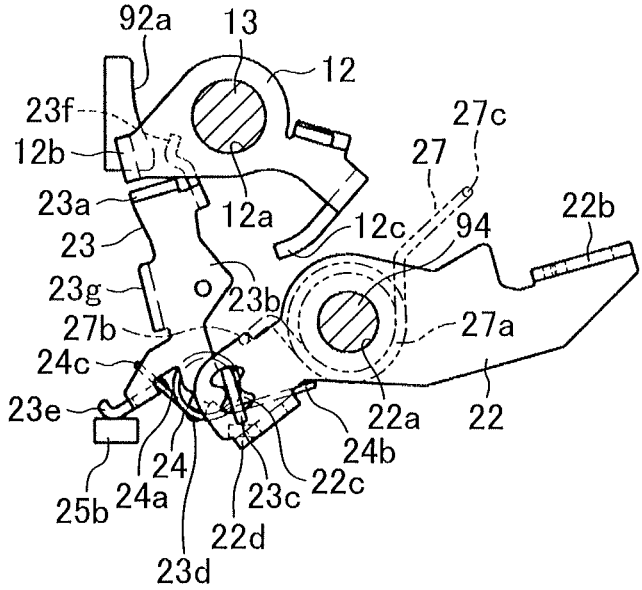
FIG. 2 is a view illustrating an unlocked state, for illustrating a relationship in a vehicle width direction of an outside open lever, springs, an open link, an active lever, a lift lever, and an unlocking position holding guide that is provided to a cover of a housing of the vehicle door lock device illustrated in FIG. 1.
Figure 3:
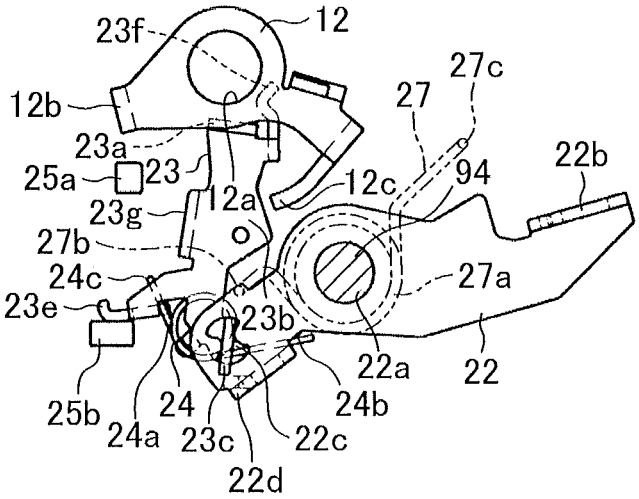
FIG. 3 is a view illustrating a locked state, for illustrating a relationship in the vehicle width direction of the outside open lever, the springs, the open link, the active lever, and the lift lever that are illustrated in FIG. 2, and a locking position holding guide that is provided to the active lever.

Now, embodiments of the present invention are described with reference to the drawings. FIG. 1 illustrates an embodiment of the present invention in which a position holding device for a rotating lever is applied to a vehicle door lock device. The vehicle door lock device is mounted to a door (not shown) provided on the front right side of a vehicle. As illustrated in FIGS. 1 to 3, the vehicle door lock device includes a latch mechanism 10, an inside open lever 21, an outside open lever 22, an open link 23, a spring 24, and an active lever 25. Further, the vehicle door lock device also includes an unlocking position holding guide 92*a* (see FIG. 2) provided to a cover (in FIG. 1, removed from a main body 91 and hence not shown) of a housing 90 (base member), and a locking position holding guide 25*a* and a push arm portion 25*b* provided to the active lever 25.

As is well known, the latch mechanism 10 is configured to hold the door in a closed state with respect to a body (vehicle body (not shown)), and is assembled to the housing 90 including the main body 91 and the cover (not shown), that is, assembled to the door together with the housing 90. The latch mechanism 10 includes: a latch (not shown) engageable with and disengageable from a striker (not shown) that is fixed to the body; a pawl (not shown) that is engageable with and disengageable from the latch and is capable of maintaining and releasing the engagement of the latch with the striker; and a lift lever 12 (see FIG. 2) provided integrally with the pawl (not shown).

As illustrated in FIG. 2, the lift lever 12 is assembled integrally to a rotation shaft 13 of the pawl (not shown) through a fitting hole 12*a* thereof, and rotates integrally with the pawl (not shown). The lift lever 12 includes an engagement arm portion 12*b* engageable with and disengageable from a push head portion 23*a* of the open link 23, and further includes a push leg portion 12*c* engageable with and disengageable from a receiving body portion 23*b* of the open link 23. A main portion of the lift lever 12 (portion of the lift lever 12 that is fitted to the rotation shaft 13) rotates in a plane substantially parallel to the drawing sheet of FIG. 2.

In the above-mentioned latch mechanism 10, when the latch engages with the striker and their engagement is maintained, the door is held in a closed state (latched state). Further, in the latch mechanism 10, when the latch disengages and separates from the striker, the door shifts from the closed state to an opened state (unlatched state).

The inside open lever 21 is rotationally drivable from an initial position (return position illustrated in FIG. 1) to an actuation position (position at which the outside open lever 22 and the open link 23 are lifted up from the position illustrated in FIG. 1 by a predetermined amount) along with a door opening operation of an inside door handle (not shown) that is provided on an inner side of the door. As illustrated in FIG. 1, the inside open lever 21 is rotatably assembled to the housing 90 through the intermediation of a support shaft 93 at a support hole 21*a*. The inside open lever 21 includes: an operation arm portion 21*b* linked to the inside door handle through the intermediation of an operation cable (not shown); a first push arm portion 21*c* engageable with and disengageable from an engagement arm portion 22*d* of the outside open lever 22; and a second push arm portion 21*d* engageable with and disengageable from a receiving portion 25*c* of the active lever 25.

The outside open lever 22 is rotationally drivable from an initial position (return position illustrated in FIGS. 2 and 3) to an actuation position (position at which the outside open lever 22 is rotated from the return position by a predetermined amount in the clockwise rotation direction of FIGS. 2 and 3) along with a door opening operation of an outside door handle (not shown) that is provided on an outer side of the door, and is rotatably assembled to the housing 90 through the intermediation of a support shaft 94 at a support hole 22*a* arranged substantially orthogonal to the support hole 21*a* of the inside open lever 21. The outside open lever 22 includes: an operation portion 22*b* linked to the outside door handle through the intermediation of an operation force transferring member (not shown) such as a link; a coupling hole portion (coupling portion) 22*c* coupled to the open link 23; and the engagement arm portion 22*d* engageable with and disengageable from the first push arm portion 21*c* of the inside open lever 21.

Further, the outside open lever 22 is urged by a spring 27 toward the initial position. The spring 27 urges the outside open lever 22 relative to the housing 90 by a predetermined urging force toward the initial position (position illustrated in FIGS. 2 and 3). Further, the spring 27 includes: a coil portion 27*a* assembled to the support shaft 94 to the housing 90; and a pair of arm portions 27*b* and 27*c* extending radially outward from end portions of the coil portion 27*a*. The arm portion 27*b* on one side engages with the outside open lever 22, and the arm portion 27*c* on the other side engages with the housing 90.

The open link 23 includes the push head portion 23*a* and the receiving body portion 23*b* mentioned above, and further includes a coupling leg portion 23*c* and a support portion 23*d*. The open link 23 is assembled into the coupling hole portion (coupling portion) 22*c* of the outside open lever 22 at the coupling leg portion 23*c* so as to be capable of tilting by a predetermined degree in a right-and-left direction of FIG. 2. The open link 23 supports the spring 24 at the support portion 23*d*. A main portion (push head portion 23*a*, receiving body portion 23*b*, and the like) of the open link 23 is tilted in a plane substantially parallel to the drawing sheet of FIG. 2, and this plane is disposed in parallel to a plane in which a main portion of the lift lever 12 rotates. Further, the open link 23 includes: an engagement leg portion 23*e* engageable with and disengageable from the push arm portion 25*b* of the active lever 25; an engagement arm portion 23*f* engageable with and disengageable from the unlocking position holding guide 92*a* of the housing 90; and an engagement body portion 23*g* engageable with and disengageable from the locking position holding guide 25*a* (see FIGS. 1 and 3) of the active lever 25.

When the inside open lever 21 is rotationally driven from the initial position to the actuation position or when the outside open lever 22 is rotationally driven from the initial position to the actuation position, the open link 23 is pushed from the initial position illustrated in FIG. 2 or 3 toward the lift lever 12, and is moved to an actuation position. Further, when the active lever 25 moves from a locking position (position illustrated in FIG. 5(*c*)) to an unlocking position (position illustrated in FIG. 5(*a*)), the open link 23 is switchable to an unlocked state (state illustrated in FIG. 2), and when the active lever 25 moves from the unlocking position to the locking position, the open link 23 is switchable to a locked state (state illustrated in FIG. 3).

Note that, when the open link 23 is held in the unlocked state, door opening actuations of the open levers 21 and 22 along with the door opening operations of the door handles are transferred to the lift lever 12 via the open link 23, respectively. On the other hand, when the open link 23 is held in the locked state, the door opening actuations of the open levers 21 and 22 along with the door opening operations of the door handles are transferred to the open link 23, but are not transferred from the open link 23 to the lift lever 12.

The spring 24 is a return spring interposed between the outside open lever 22 and the open link 23, and urges the open link 23 into the unlocked state (state illustrated in FIG. 2) with respect to the outside open lever 22. Under a state in which the open link 23 is engaged with the active lever 24, the spring 24 constantly urges the active lever 24 toward the unlocking position. Further, the spring 24 includes: a coil portion 24*a* assembled to the support portion 23*d* of the open link 23; and a pair of arm portions 24*b* and 24*c* extending radially outward from end portions of the coil portion 24*a*. The arm portion 24*b* on one side engages with the outside open lever 22, and the arm portion 24*c* on the other side engages with the open link 23. Note that, an urging force of the spring 24 is set to be smaller than the urging force of the spring 27.

Thus, in the door-locked state (state in which the door is locked), when the door handles (not shown) and a lock/unlock operation member (lock knob (not shown) provided on the inner side of the door, key cylinder (not shown) capable of being operated from the outer side of the door, remote control device for actuating an electric motor 31 (see FIG. 1) of a driving mechanism 30, or the like) are operated simultaneously and thus the vehicle door lock device is brought into a panic state, owing to the function of the spring 24, the open link 23 is urged to be brought into the unlocked state, and is retained elastically and relatively movable to the engagement arm portion 12*b* of the lift lever 12. In this manner, the open link 23 is permitted to return to the initial position illustrated in FIG. 2.

Figure 5:
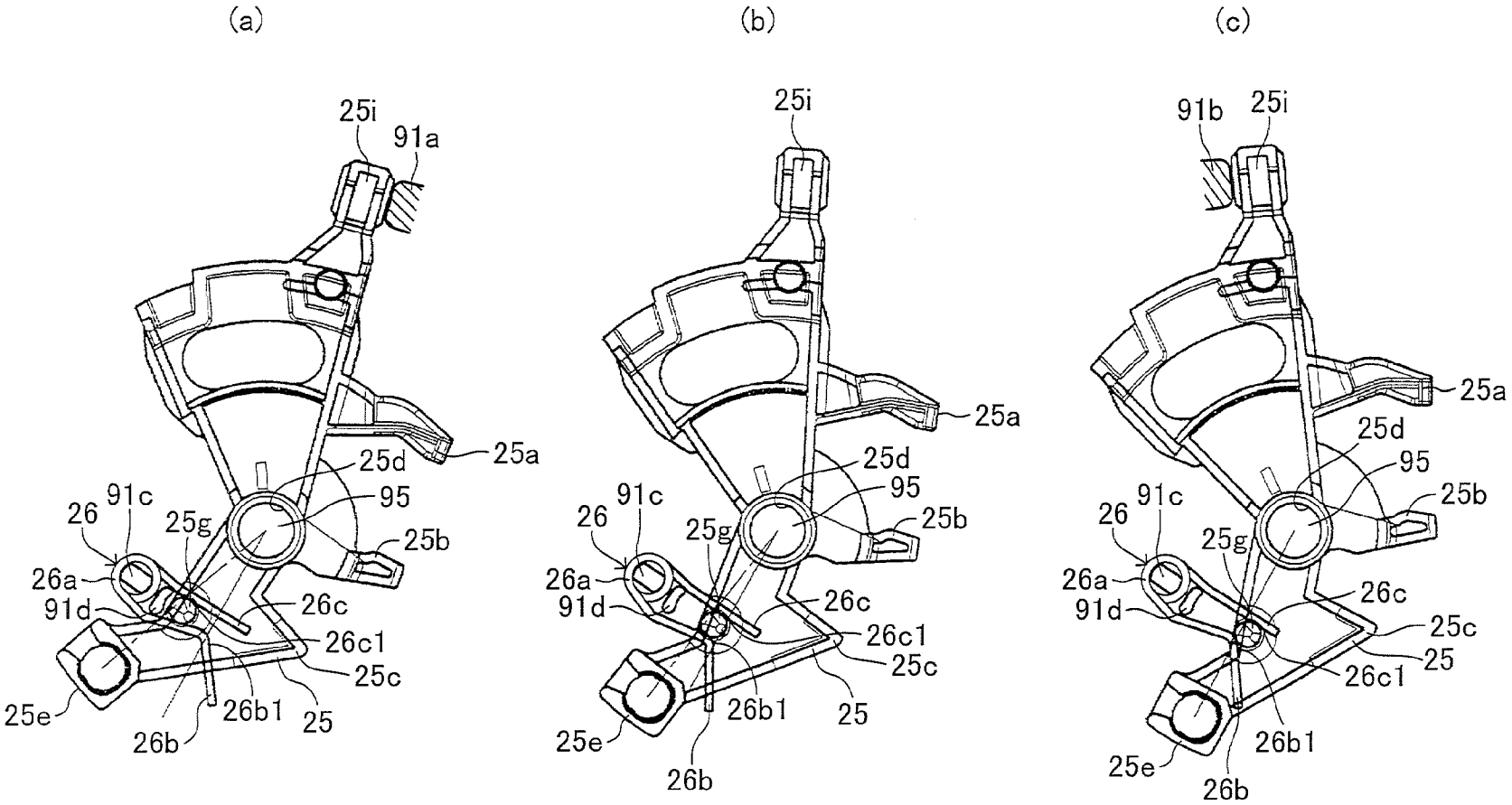
FIG. 5 are explanatory operational views each illustrating a relationship between the active lever (rotating lever), both stopper portions (stopper members), and the torsion spring that are illustrated in FIG. 1.

Through a locking operation of the lock/unlock operation member, the active lever 25 is switched from the unlocking position illustrated in FIGS. 1 and 5(*a*) to the locking position illustrated in FIG. 5(*c*) so as to bring the open link 23 into the locked state illustrated in FIG. 3. Further, through an unlocking operation of the lock/unlock operation member, the active lever 25 is switched from the locking position to the unlocking position so as to bring the open link 23 into the unlocked state. The active lever 25 is supported by being rotatably assembled to the housing 90 through the intermediation of a support shaft 95 at a support hole 25*d* formed in a boss portion of the active lever 25.

The active lever 25 includes the locking position holding guide 25*a*, the push arm portion 25*b*, the receiving portion 25*c*, and the support hole 25*d* mentioned above. The active lever 25 further includes: an operation portion 25*e* coupled through the intermediation of an operation cable (not shown) to the lock knob (not shown) provided on the inner side of the door; a driving portion 25*f* linked to the driving mechanism 30; an engagement pin portion 25*g* (see FIG. 1) linked to a positioning torsion spring 26; and an engagement pin portion 25*h* linked through the intermediation of a locking control lever 41, a key switch lever 42, an outside locking lever 43, and the like to the key cylinder (not shown) provided on the outer side of the door.

Further, the active lever 25 includes a protruding portion 25*i* arranged between a first stopper portion (first stopper member) 91*a* and a second stopper portion (second stopper member) 91*b* that are provided to the main body 91 of the housing 90, and the positioning torsion spring 26 is assembled in the housing 90 and engaged with the engagement pin portion 25*g* (see FIG. 1) provided to the active lever 25. With this, the active lever 25 is held elastically at the unlocking position (position at which the protruding portion 25*i* abuts against the first stopper portion 91*a* as illustrated in FIGS. 1 and 5(*a*)), or at the locking position (position at which the protruding portion 25*i* abuts against the second stopper portion 91*b* as illustrated in FIG. 5(*c*)).

A holding force (force of holding the active lever 25 at the locking position) of the torsion spring 26 is set to be larger than the urging force of the spring 27 (force for urging the outside open lever 22 toward the initial position). Thus, in the door-locked state, the outside open lever 22, the open link 23, the active lever 25, and the like are held in the state illustrated in FIG. 3.

When the active lever 25 is held at the unlocking position, the push arm portion 25*b* is engageable with the engagement leg portion 23*e* of the open link 23 so as to switch the active lever 25 from the unlocking position (position of FIG. 2) to the locking position (position of FIG. 3), to thereby tilt the open link 23 in the unlocked state. In addition, when the active lever 25 is held at the locking position, the push arm portion 25*b* is disengageable from the open link 23 so as to permit the open link 23 in the locked state to move into the unlocked state.

Figure 6:
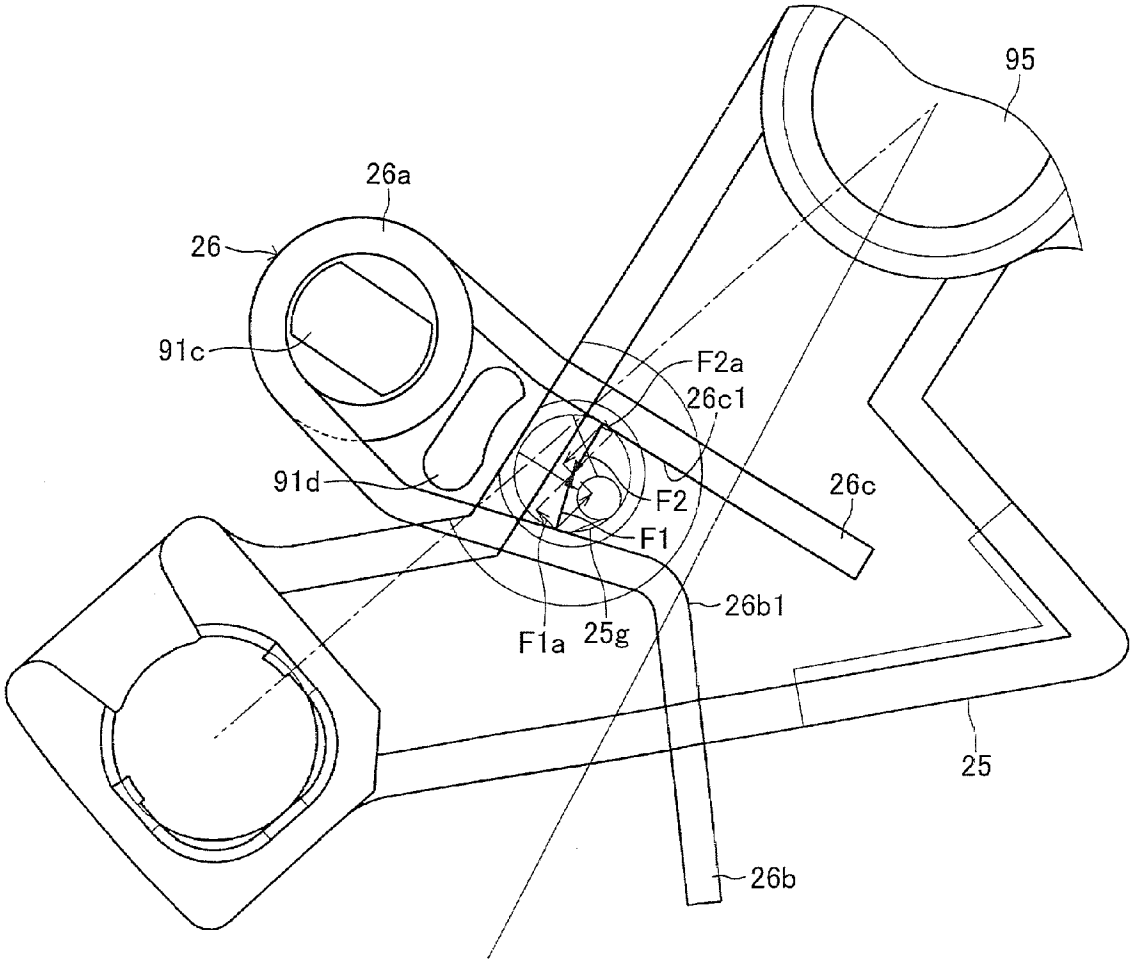
FIG. 6 is a view illustrating a relationship between a spring force to be applied from a first arm part of the torsion spring illustrated in FIG. 5(*a*) to an engagement portion of the active lever, and a spring force to be applied from a second arm part of the torsion spring to the engagement portion of the active lever.

By the way, in this embodiment, the protruding portion 25*i*, the first stopper portion 91*a*, the second stopper portion 91*b*, the engagement pin portion 25*g*, the torsion spring 26, and the like serve as a position holding device for the active lever 25 (rotating lever). Note that, in FIGS. 5 and 6, in order to clarify engagement between the engagement pin portion 25*g* of the active lever 25 and the torsion spring 26, the engagement pin portion 25*g* and the torsion spring 26 are each illustrated by solid lines.

Figure 4:
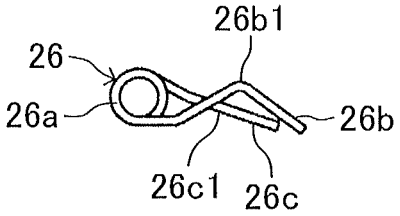
FIG. 4 is a side view illustrating a free state of a torsion spring illustrated in FIG. 1 alone.

The torsion spring 26 is interposed between the active lever 25 and the main body 91 of the housing 90, and is configured to urge the protruding portion 25*i* of the active lever 25 (active lever 25) toward the first stopper portion 91*a* when the active lever 25 is held at the unlocking position (first position), and to urge the protruding portion 25*i* of the active lever 25 (active lever 25) toward the second stopper portion 91*b* when the active lever 25 is held at the locking position (second position). The torsion spring 26 is formed of a wire rod of spring steel, and includes a coiled part 26*a*, a first arm part 26*b*, and a second arm part 26*c*. In a free state, as illustrated in FIG. 4, the first arm part 26*b* and the second arm part 26*c* intersect with each other.

The coiled part 26*a* is mounted to be rotatable about a boss portion 91*c* provided upright from the main body 91 of the housing 90 (supported by a base member). Under an assembled state as illustrated in FIG. 1, the first arm part 26*b* and the second arm part 26*c* extend from the coiled part 26*a* in a radial direction substantially orthogonal to an axial direction of the boss portion 91*c*, and face each other across the engagement pin portion 25*g* provided to the active lever 25. Note that, a projection portion 91*d* is arranged between the first arm part 26*b* and the second arm part 26*c* illustrated in FIG. 1. The projection portion 91*d* is provided to the main body 91 of the housing 90 so as to abut against the first arm part 26*b* and the second arm part 26*c* and deflect the first arm part 26*b* and the second arm part 26*c* into a direction in which a clearance therebetween is increased when the torsion spring 26 is supported about the boss portion 91*c*. In this way, an assembly initial state of the torsion spring 26 is set.

The first arm part 26*b* is provided with a mountain portion (projection-like bent portion) 26*b*1 including a top portion that is brought into engagement with the engagement pin portion 25*g* of the active lever 25 in a manner that the engagement pin portion 25*g* climbs over the top portion at an intermediate part of a circular-arc locus formed along with the rotation of the active lever 26 from the first position to the second position. The mountain portion 26*b*1 urges the active lever 25 toward the first stopper portion 91*a* with an urging force in a rotation direction component force F1*a* of a spring force F1 indicated in FIG. 6 when the active lever 25 is held at the first position (state of FIG. 5(*a*)), and urges the active lever 25 toward the second stopper portion 91*b* when the active lever 25 is held at the second position (state of FIG. 5(*c*)).

Note that, even when the engagement pin portion 25*g* of the active lever 25 shifts between the position illustrated in FIG. 5(*a*) and the position illustrated FIG. 5(*b*), the active lever 25 is kept urged by the first arm part 26*b* toward the first stopper portion 91*a* similarly to the state in which the active lever 25 is held at the first position. Further, even when the engagement pin portion 25*g* of the active lever 25 shifts between the position illustrated in FIG. 5(*b*) and the position illustrated in FIG. 5(*c*), the active lever 25 is kept urged by the first arm part 26*b* toward the second stopper portion 91*b* similarly to the state in which the active lever 25 is held at the second position.

Meanwhile, the second arm part 26*c* is provided with a straight portion (urging portion) 26*c*1 that is brought into engagement with the engagement pin portion 25*g* of the active lever 25 in a manner that the engagement pin portion 25*g* constantly slides downward (engagement pin portion 25*g* receives an urging force in a rotation direction component force toward a distal end of the second arm part 26*c*) along the circular-arc locus formed along with the rotation of the active lever 25 from the first position to the second position. The straight portion 26*c*1 urges the active lever 25 toward the second stopper portion 91*b* with an urging force in a rotation direction component force F2*a* of a spring force F2 indicated in FIG. 6 (urging force smaller than the urging force (F1*a*) exerted by the first arm part 26*b* toward the first stopper portion 91*a*) when the active lever 25 is held at the first position, and urges the active lever 25 toward the second stopper portion 91*b* when the active lever 25 is held at the second position. Note that, when the engagement pin portion 25*g* of the active lever 25 is engaged with the straight portion 26*c*1, the active lever 25 is kept urged by the second arm part 26*c* toward the second stopper portion 91*b*.

As described above, in the structure of this embodiment, when the active lever 25 rotates from the first position to the second position and rotates from the second position to the first position, the engagement pin portion 25*g* of the active lever 25 climbs, at the intermediate part of the circular-arc locus, over the top portion of the mountain portion 26*b*1 provided to the first arm part 26*b* of the torsion spring 26. Thus, the active lever 25 is allowed to provide tactile feedback. Further, when the active lever 25 rotates from the second position to the first position, after the engagement pin portion 25*g* of the active lever 25 climbs over the top portion of the mountain portion 26*b*1 provided to the first arm part 26*b* of the torsion spring 26 and before the protruding portion 25*i* of the active lever 25 abuts against the first stopper portion 91*a*, the engagement pin portion 25*g* of the active lever 25 is urged toward the second stopper portion 91*b* by the straight portion 26*c*1 provided to the second arm part 26*c* of the torsion spring 26 with the urging force smaller than the urging force exerted by the first arm part 26*b* of the torsion spring 26 toward the first stopper portion 91*a* (F2*a*<F1*a*).

Thus, the urging force (F2*a*) generated toward the second stopper portion 91*b* by the straight portion 26*c*1 provided to the second arm part 26*c* of the torsion spring 26 is applied to the active lever 25 as a braking force against the urging force (F1*a*) generated toward the first stopper portion 91*a* by the mountain portion 26*b*1 provided to the first arm part 26*b* of the torsion spring 26. Thus, an abutment noise generated when the active lever 25 abuts against the first stopper portion 91*a* can be reduced. Thus, it is unnecessary to take a measure to reduce the abutment noise (such as provision of a buffer between an abutment part of the active lever 25 with respect to the first stopper portion 91*a* and the first stopper portion 91*a*, and a change of a raw material for the abutment part of the active lever 25 with respect to the first stopper portion 91*a* or a raw material for the first stopper portion 91*a* to a raw material having a buffer function). As a result, the number of components for the measure to reduce the abutment noise is not increased, or material cost is not increased.

Further, this embodiment can be carried out by changing a shape of the second arm part 26*c* of the torsion spring 26, specifically, by using the straight portion 26*c*1 (simple structure) instead of a conventional mountain portion (projection-like bent portion) provided to the second arm part 26*c* of the torsion spring 26. In this way, this embodiment can be carried out at low cost by utilizing a conventional structure.

Figure 7:
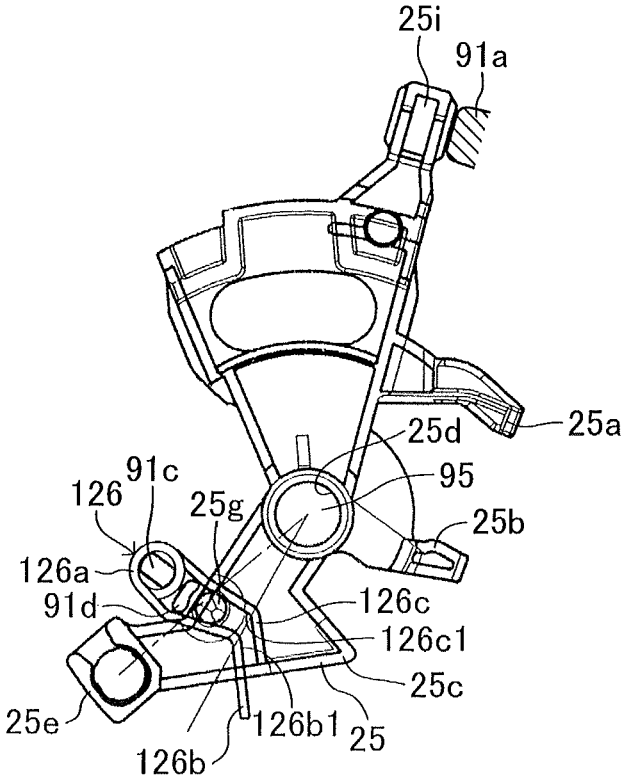
FIG. 7 is a view corresponding to FIG. 5(*a*), for illustrating a modification of the torsion spring illustrated in FIG. 1.

As described above, this embodiment is carried out by employing the torsion spring 26 described above. However, this embodiment may be carried out by using a torsion spring 126 illustrated in FIG. 7 instead of the torsion spring 26 described above. The torsion spring 126 illustrated in FIG. 7 is formed of a wire rod of spring steel, and includes a coiled part 126*a*, a first arm part 126*b*, and a second arm part 126*c*, and a valley portion (recess-like bent portion) 126*c*1 is formed at an intermediate part of the second arm part 126*c*. The remaining structure is the same as that of the torsion spring 26 of the embodiment described above.

The valley portion (recess-like bent portion) 126*c*1 is provided instead of the straight portion (urging portion) 26*c*1 of the embodiment described above, and includes a first urging portion corresponding to from the coiled part 126*a* to a valley-bottom part, and a second urging portion corresponding to from the valley-bottom part to a distal end part. The first urging portion is brought into engagement with the engagement pin portion 25*g* when the active lever 25 shifts from the intermediate part to the first position, and urges the active lever 25 toward the second stopper portion 91*b* with an urging force smaller than an urging force exerted toward the first stopper portion 91*a* by the first arm part 126*b* when the active lever 25 is held at the first position. The second urging portion is brought into engagement with the engagement pin portion 25*g* when the active lever 25 shifts from the intermediate part to the second position, and urges the active lever 25 toward the first stopper portion 91*a* with an urging force smaller than an urging force exerted toward the second stopper portion 91*b* by the first arm part 126*b* when the active lever 25 is held at the second position.

Thus, in a modification illustrated in FIG. 7, a braking force is generated by the first urging portion before the active lever 25 abuts against the first stopper portion 91*a*, and another braking force is generated by the second urging portion before the active lever 25 abuts against the second stopper portion 91*b*. In this way, the abutment noise generated when the active lever 25 abuts against the first stopper portion 91*a* can be reduced, and an abutment noise generated when the active lever 25 abuts against the second stopper portion 91*b* also can be reduced.

Further, the embodiment described above is carried out by employing the torsion spring 26 described above, but the following torsion spring (including a second arm part different from the second arm part (26*c*) only in shape and function) may be employed instead of the torsion spring 26 described above. The second arm part of the torsion spring is provided with a straight portion (26*c*1) that is brought into the engagement with the engagement portion (engagement pin portion 25*g*) in a manner that the engagement portion (engagement pin portion 25*g*) constantly slides upward (the engagement portion (engagement pin portion 25*g*) receives an urging force in a rotation direction component force toward a proximal end (end portion on the coiled part 26*a* side) of the second arm part 26*c* of the embodiment described above) along the circular-arc locus formed along with the rotation of the rotating lever (active lever 25) from the first position to the second position. The straight portion (26*c*1) urges the rotating lever (25) toward the first stopper member (91*a*) when the rotating lever (25) is held at the first position, and urges the active lever (25) toward the first stopper member (91*a*) with an urging force smaller than the urging force exerted by the first arm part (26*b*) toward the second stopper member (91*b*) when the active lever (25) is held at the second position.

In this embodiment, when the rotating lever rotates from the first position to the second position and rotates from the second position to the first position, the engagement portion of the rotating lever climbs, at the intermediate part of the circular-arc locus, over the top portion of the mountain portion provided to the first arm part of the torsion spring. Thus, the rotating lever is allowed to provide tactile feedback. Further, when the rotating lever rotates from the first position to the second position, after the engagement portion of the rotating lever climbs over the top portion of the mountain portion provided to the first arm part of the torsion spring and before the rotating lever abuts against the second stopper member, the engagement portion of the rotating lever is urged toward the first stopper member by the straight portion provided to the second arm part of the torsion spring with the urging force smaller than the urging force exerted by the first arm part of the torsion spring toward the second stopper member.

Thus, the urging force generated toward the first stopper member by the straight portion provided to the second arm part of the torsion spring is applied to the rotating lever as a braking force against the urging force generated toward the second stopper member by the mountain portion provided to the first arm part of the torsion spring. Thus, the abutment noise generated when the rotating lever abuts against the second stopper member can be reduced. Thus, it is unnecessary to take a measure to reduce the abutment noise (such as provision of a buffer between an abutment part of the rotating lever with respect to the second stopper member and the second stopper member, and a change of a raw material for the abutment part of the rotating lever with respect to the second stopper member or a raw material for the second stopper member to a raw material having a buffer function). As a result, the number of components for the measure to reduce the abutment noise is not increased, or material cost is not increased.

Further, this embodiment also can be carried out by changing the shape of the second arm part of the torsion spring; specifically, by using the straight portion instead of the conventional mountain portion (projection-like bent portion) provided to the second arm part of the torsion spring. In this way, this embodiment also can be carried out at low cost by utilizing a conventional structure. Note that, this embodiment can be carried out also by changing the shape of the second arm part 26*c* of the torsion spring 26 (how to engage the straight portion 26*c*1 with respect to the engagement pin portion 25*g* of the active lever 25) of the embodiments described above. Alternatively, this embodiment can be carried out also by reversing the arrangement of the torsion spring 26 in each of the embodiments described above in a rotation direction of the active lever 25.

Further, in each of the embodiments described above, the rotating lever is used as the active lever of the vehicle door lock device. However, the present invention may be employed as position holding devices for various rotating levers as long as the rotating lever is rotatably supported by the base member in a manner that the rotating lever abuts against the first stopper member to be held at the first position, and abuts against the second stopper member to be held at the second position.

The invention claimed is:

1. A position holding device for a rotating lever, comprising:

a rotating lever that is rotatably supported by a base member in a manner that the rotating lever abuts against a first stopper member to be held at a first position, and abuts against a second stopper member to be held at a second position;

a torsion spring that is interposed between the rotating lever and the base member, urges the rotating lever toward the first stopper member at the first position, and urges the rotating lever toward the second stopper member at the second position, the position holding device being capable of holding the rotating lever elastically at two positions including the first position and the second position, wherein the torsion spring comprises:

a coiled part supported by the base member; and a first arm part and a second arm part each extending from the coiled part in a radial direction thereof, the first arm part and the second arm part facing each other across an engagement portion provided to the rotating lever, wherein the first arm part comprises a mountain portion comprising a top portion that is brought into engagement with the engagement portion in a manner that the engagement portion climbs over the top portion at an intermediate part of a circular-arc locus formed along with rotation of the rotating lever from the first position to the second position, the mountain portion urging the rotating lever toward the first stopper member when the rotating lever is held at the first position, and urging the rotating lever toward the second stopper member when the rotating lever is held at the second position, and wherein the second arm part comprises an urging portion that is brought into engagement with the engagement portion when the rotating lever rotates at least from the intermediate part to the first position, the urging portion urging the rotating lever toward the second stopper member with an urging force smaller than an urging force exerted by the first arm part toward the first stopper member when the rotating lever is held at the first position; and a spring for constantly urging the rotating lever toward the first position with an urging force smaller than an urging force of the torsion spring.

2. A position holding device for a rotating lever according to claim 1, wherein the urging portion comprises a straight portion that is brought into the engagement with the engagement portion in a manner that the engagement portion constantly slides downward along the circular-arc locus formed along with the rotation of the rotating lever from the first position to the second position, the straight portion urging the rotating lever toward the second stopper member with the urging force smaller than the urging force exerted by the first arm part toward the first stopper member when the rotating lever is held at the first position, and urging the rotating lever toward the second stopper member when the rotating lever is held at the second position.

3. A position holding device for a rotating lever according to claim 1, wherein the urging portion comprises:

a first urging portion that is brought into engagement with the engagement portion when the rotating lever rotates from the intermediate part to the first position, the first urging portion urging the rotating lever toward the second stopper member with an urging force smaller than the urging force exerted by the first arm part toward the first stopper member when the rotating lever is held at the first position; and a second urging portion that is brought into engagement with the engagement portion when the rotating lever rotates from the intermediate part to the second position, the second urging portion urging the rotating lever toward the first stopper member with an urging force smaller than an urging force exerted by the first arm part toward the second stopper member when the rotating lever is held at the second position.

4. A vehicle door lock device, comprising:

the position holding device for a rotating lever according to claim 1;

a latch mechanism that is capable of holding a door in a closed state with respect to a vehicle body, and comprises a lift lever; and an open link that shifts from a locked position at which the open link is engageable with the lift lever to an unlocked position at which the open link is unengageable with the lift lever so as to switch the door from a locked state to an unlocked state;

wherein the rotating lever comprises an active lever that rotates between the first position and the second position, the first position corresponding to the unlocked position of the open link and the second position corresponding to the locked position of the open link, and wherein the spring comprises a return spring for urging the open link toward the unlocked position.

5. A position holding device for a rotating lever, comprising:

a rotating lever that is rotatably supported by a base member in a manner that the rotating lever abuts against a first stopper member to be held at a first position, and abuts against a second stopper member to be held at a second position;

a torsion spring that is interposed between the rotating lever and the base member, urges the rotating lever toward the first stopper member at the first position, and urges the rotating lever toward the second stopper member at the second position, the position holding device being capable of holding the rotating lever elastically at two positions including the first position and the second position, wherein the torsion spring comprises:

a coiled part supported by the base member; and a first arm part and a second arm part each extending from the coiled part in a radial direction substantially orthogonal to an axial direction of a boss portion, the first arm part and the second arm part facing each other across an engagement portion provided to the rotating lever, wherein the first arm part comprises a mountain portion comprising a top portion that is brought into engagement with the engagement portion in a manner that the engagement portion climbs over the top portion at an intermediate part of a circular-arc locus formed along with rotation of the rotating lever from the first position to the second position, the mountain portion urging the rotating lever toward the first stopper member when the rotating lever is held at the first position, and urging the rotating lever toward the second stopper member when the rotating lever is held at the second position, and wherein the second arm part comprises a straight portion that is brought into engagement with the engagement portion in a manner that the engagement portion constantly slides upward along the circular-arc locus formed along with the rotation of the rotating lever from the first position to the second position, the straight portion urging the rotating lever toward the first stopper member when the rotating lever is held at the first position, and urging the rotating lever toward the first stopper member with an urging force smaller than an urging force exerted by the first arm part toward the second stopper member when the rotating lever is held at the second position, and a spring for constantly urging the rotating lever toward the first position with an urging force smaller than an urging force of the torsion spring.

* * * * *